US008156800B2

(12) United States Patent
Terabayashi et al.

(10) Patent No.: US 8,156,800 B2
(45) Date of Patent: Apr. 17, 2012

(54) METHODS AND APPARATUS TO EVALUATE SUBTERRANEAN FORMATIONS

(75) Inventors: Toru Terabayashi, Sagamihara (JP); Emmanuel Desroques, Paris (FR); Satoru Umemoto, Tokyo (JP); Anthony Smits, Kawasaki (JP); Hidenori Tsuboi, Hachioji (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 682 days.

(21) Appl. No.: 12/343,477

(22) Filed: Dec. 24, 2008

(65) Prior Publication Data

US 2010/0154529 A1 Jun. 24, 2010

(51) Int. Cl.
*E21B 49/08* (2006.01)

(52) U.S. Cl. ..... 73/152.27

(58) Field of Classification Search ..... 73/152.17, 73/152.18, 152.24, 152.27, 152.28, 152.31
See application file for complete search history.

(56) References Cited

U.S. PATENT DOCUMENTS

| | | | | |
|---|---|---|---|---|
| 5,329,811 | A | 7/1994 | Schultz et al. | |
| 6,234,030 | B1 * | 5/2001 | Butler | 73/861.04 |
| 7,021,405 | B2 * | 4/2006 | Proett et al. | 175/65 |
| 7,395,712 | B2 * | 7/2008 | Irani et al. | 73/597 |
| 7,445,043 | B2 * | 11/2008 | Mullins et al. | 166/250.01 |
| 7,461,547 | B2 * | 12/2008 | Terabayashi et al. | 73/152.55 |
| 7,878,243 | B2 * | 2/2011 | Goodwin et al. | 166/264 |
| 2004/0231408 | A1 * | 11/2004 | Shammai | 73/152.27 |
| 2006/0243047 | A1 * | 11/2006 | Terabayashi et al. | 73/152.55 |
| 2007/0214877 | A1 * | 9/2007 | Shammai | 73/152.24 |
| 2008/0066537 | A1 * | 3/2008 | Hegeman et al. | 73/152.28 |
| 2009/0316528 | A1 * | 12/2009 | Ramshaw et al. | 367/83 |

FOREIGN PATENT DOCUMENTS

| | | |
|---|---|---|
| GB | 2338563 | 12/1999 |
| WO | 02093126 | 11/2002 |
| WO | 2004099552 | 11/2004 |
| WO | 2004104374 | 12/2004 |

* cited by examiner

*Primary Examiner* — John Fitzgerald
(74) *Attorney, Agent, or Firm* — Jianguang Du; Jody DeStefanis; Jeff Griffin

(57) ABSTRACT

Methods and apparatus to evaluate subterranean formations are described. An example method of evaluating a subterranean formation includes, obtaining a first sample from a first wellbore location. Additionally, the example method includes obtaining a second sample from a second wellbore location different than the first wellbore location. Further, the example method includes mixing the first sample with the second sample in a flowline to obtain a substantially homogenous mixture. Further still, the example method includes measuring a parameter of the mixture to evaluate the subterranean formation.

19 Claims, 7 Drawing Sheets

METHODS AND APPARATUS TO EVALUATE SUBTERRANEAN FORMATIONS

FIELD OF THE DISCLOSURE

This patent relates generally to sampling and analyzing formation fluids and, more particularly, to methods and apparatus to evaluate subterranean formations.

BACKGROUND

During production operations, the temperature and pressure at which fluid extracted from a subterranean formation is maintained affects the phase of the fluid as well as the magnitude of precipitated asphaltenes, production equipment, etc. In particular, as the pressure of an unsaturated formation fluid decreases, asphaltenes that were once dissolved in the formation fluid begin to precipitate. Precipitated asphaltenes have been known to clog wells, flowlines, surface facilities and/or subsurface facilities. However, the temperature and pressure of the fluid as it is brought to the surface may be controlled to minimize some of the adverse effects of asphaltenes as well as phase changes during production operations.

To identify the asphaltene onset pressure and the bubble point of a formation fluid, known techniques rely heavily on laboratory analysis. While such laboratory analysis may provide accurate results in some instances, to do so the sample must be representative of the formation fluid and be maintained at reservoir conditions while being transported to the laboratory. Additionally, laboratory analysis does not provide real-time results.

SUMMARY

An example method of evaluating a subterranean formation includes, obtaining a first sample from a first wellbore location. Additionally, the example method includes obtaining a second sample from a second wellbore location different than the first wellbore location. Further, the example method includes mixing the first sample with the second sample in a flowline to obtain a substantially homogenous mixture. Further still, the example method includes measuring a parameter of the mixture to evaluate the subterranean formation.

An example method of identifying an asphaltene onset pressure of a mixed fluid obtained from a subterranean formation includes obtaining a mixed fluid from the subterranean formation. Additionally, the example method includes changing a pressure of the mixed fluid. Further, the example method includes identifying the asphaltene onset pressure to limit or eliminate precipitation of asphaltenes during sampling or production.

DETAILED DESCRIPTION

Figure 1:
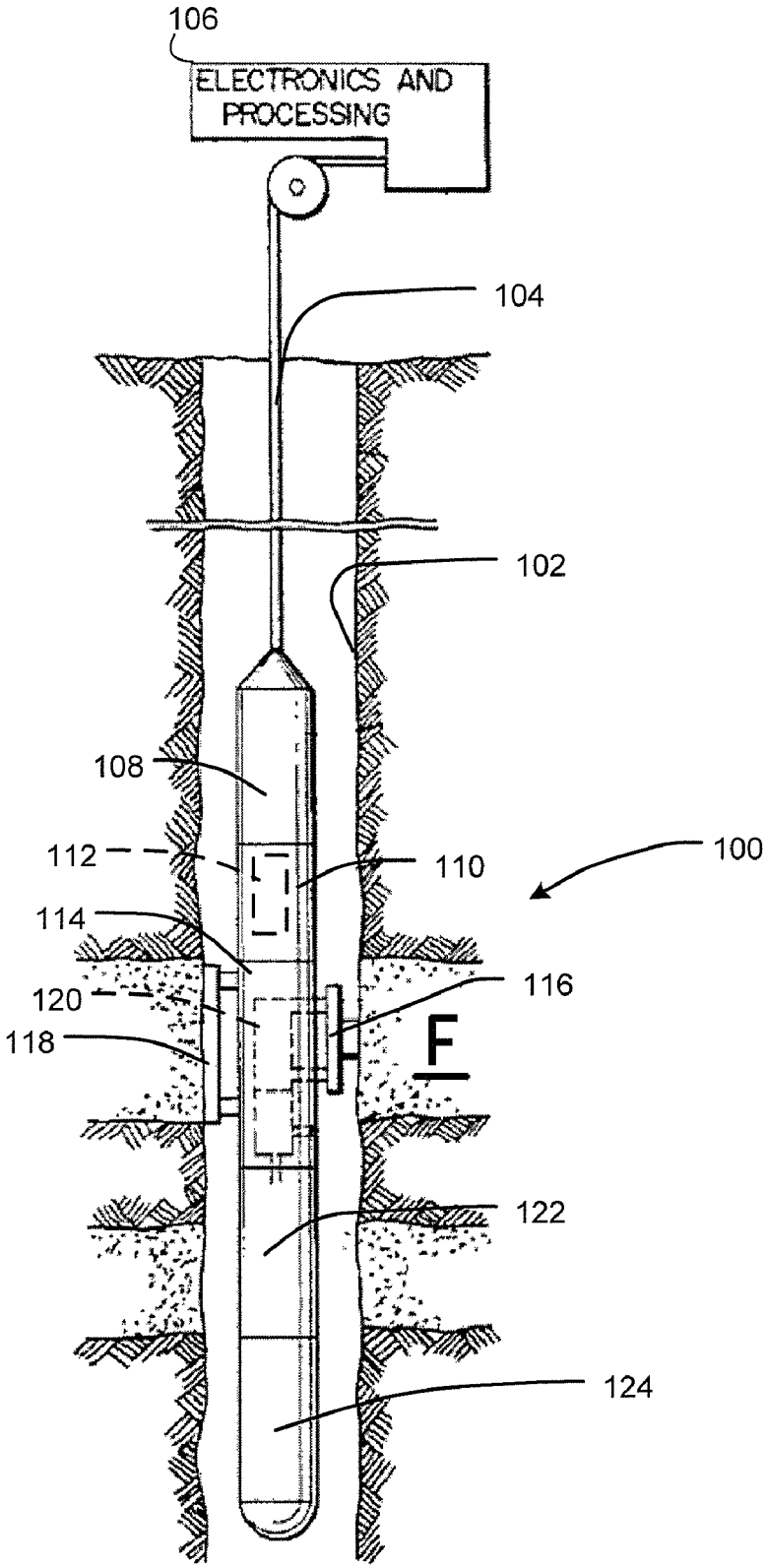
FIG. 1 depicts an example wireline tool that may be used to implement the methods and apparatus described herein.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The example methods and apparatus described herein can be used to evaluate subterranean formations. In particular, the example methods and apparatus described herein may be advantageously utilized to understand how different production zones, which have fluids with varying composition, affect production operations. Specifically, the examples described herein involve obtaining samples from a plurality of wellbore locations and identifying parameters of the fluid to optimize a production strategy.

In one described example, a probe assembly obtains a first sample from a first wellbore location and then obtains a second sample from a second wellbore location. In particular, the probe assembly obtains fluid from a first wellbore location, which is then pumped through a flowline where a sensor determines a contamination level of the fluid and if the fluid is a single phase. Once it is determined that the fluid from the first wellbore location is acceptable, the fluid is routed to a bypass line. Similarly, the probe assembly then obtains fluid from a second wellbore location, which is then pumped through the flowline where the sensor determines a contamination level of the fluid and if the fluid is a single phase. Once it is determined that the fluid from the second wellbore location is acceptable, the fluid is routed to the bypass line. In some examples, a flow meter may control a ratio of the fluid from the first wellbore location relative to the fluid from the second wellbore location.

After the fluid samples from the different wellbore locations are in the bypass line, a pump mixes or circulates the fluid samples to obtain a substantially homogeneous mixture. A pressure control unit then decreases the pressure of the mixture to determine phase behavior of the mixture and/or to identify the temperature and/or pressure at which particles (e.g., asphaltenes or bubbles) appear in the fluid. In particular, as the pressure of the mixture is reduced, a particle detector detects the presence of particles in the fluid and a fluid measurement unit differentiates between the different particles. Generally, the temperature and pressure at which a bubble (i.e., a separating gas phase) is initially detected in the fluid is associated with a bubble point. Similarly, the temperature and pressure at which a precipitated asphaltene (i.e., a separating solid phase) is initially detected in the fluid is associated with an asphaltene onset pressure. After the sampling operation is performed, the pressure control unit may increase the pressure in the bypass line to redissolve the particles (e.g., asphaltene, bubbles, etc.) in the formation fluid.

FIG. 1 depicts an example wireline tool 100 that may be used to extract and analyze formation fluid samples and which may be used to evaluate a subterranean formation using the example methods and apparatus described herein. In particular, the example wireline tool 100 may be used in conjunction with the example methods and apparatus to determine a parameter of a mixed fluid obtained from a subterranean formation, which may be advantageously utilized to determine and/or evaluate a production strategy. As shown in FIG. 1, the example wireline tool 100 is suspended in a borehole or wellbore 102 from the lower end of a multiconductor cable 104 that is spooled on a winch (not shown) at the surface. At the surface, the cable 104 is communicatively coupled to an electronics and processing system 106. The wireline tool 100 includes an elongated body 108 that includes a collar 110 having a downhole control system 112 configured to control extraction of formation fluid from the formation F, measurements performed on the extracted fluid as well as to control the apparatus described herein to evaluate the formation F.

The example wireline tool 100 also includes a formation tester 114 having a selectively extendable fluid admitting assembly 116 and a selectively extendable tool anchoring member 118 that are respectively arranged on opposite sides of the elongated body 108. The fluid admitting assembly 116 is configured to selectively seal off or isolate selected portions of the wall of the wellbore 102 to fluidly couple the adjacent formation F and draw fluid samples from the formation F. The formation tester 114 also includes a fluid analysis module 120 through which the obtained fluid samples flow. The fluid may thereafter be expelled through a port (not shown) or it may be sent to one or more fluid collecting chambers 122 and 124, which may receive and retain the formation fluid for subsequent testing at the surface or a testing facility.

In the illustrated example, the electronics and processing system 106 and/or the downhole control system 112 are configured to control the fluid admitting assembly 116 to draw fluid samples from the formation F and to control the fluid analysis module 120 to measure the fluid samples. In some example implementations, the fluid analysis module 120 may be configured to analyze the measurement data of the fluid samples as described herein. In other example implementations, the fluid analysis module 120 may be configured to generate and store the measurement data and subsequently communicate the measurement data to the surface for analysis at the surface. Although the downhole control system 112 is shown as being implemented separate from the formation tester 114, in some example implementations, the downhole control system 112 may be implemented in the formation tester 114.

As described in greater detail below, the example wireline tool 100 may be used in conjunction with the example methods and apparatus described herein to determine parameters of the formation fluid. Such parameters may include, for example, an asphaltene onset pressure, a bubble point and/or a dew point of a mixed fluid obtained from, for example, the formation F. Information obtained using the example methods and apparatus described herein may be later advantageously used to limit and/or eliminate precipitation of asphaltenes and/or phase changes during production or sampling operations. In some examples, the formation tester 114 may include one or more sensors, fluid analyzers and/or fluid measurement units disposed adjacent a flowline and may be controlled by one or both of the downhole control system 112 and the electronics and processing system 106 to determine one or more parameters and/or characteristics of the fluid samples extracted from, for example, the formation F.

While the example methods and apparatus to evaluate a subterranean formation are described in connection with a wireline tool such as that shown in FIG. 1, the example methods and apparatus can be implemented with any other type of wellbore conveyance. For example, the example methods and apparatus can be implemented with a drill string including logging-while-drilling (LWD) and/or measurement-while-drilling (MWD) modules, coiled tubing, etc.

Figure 2:
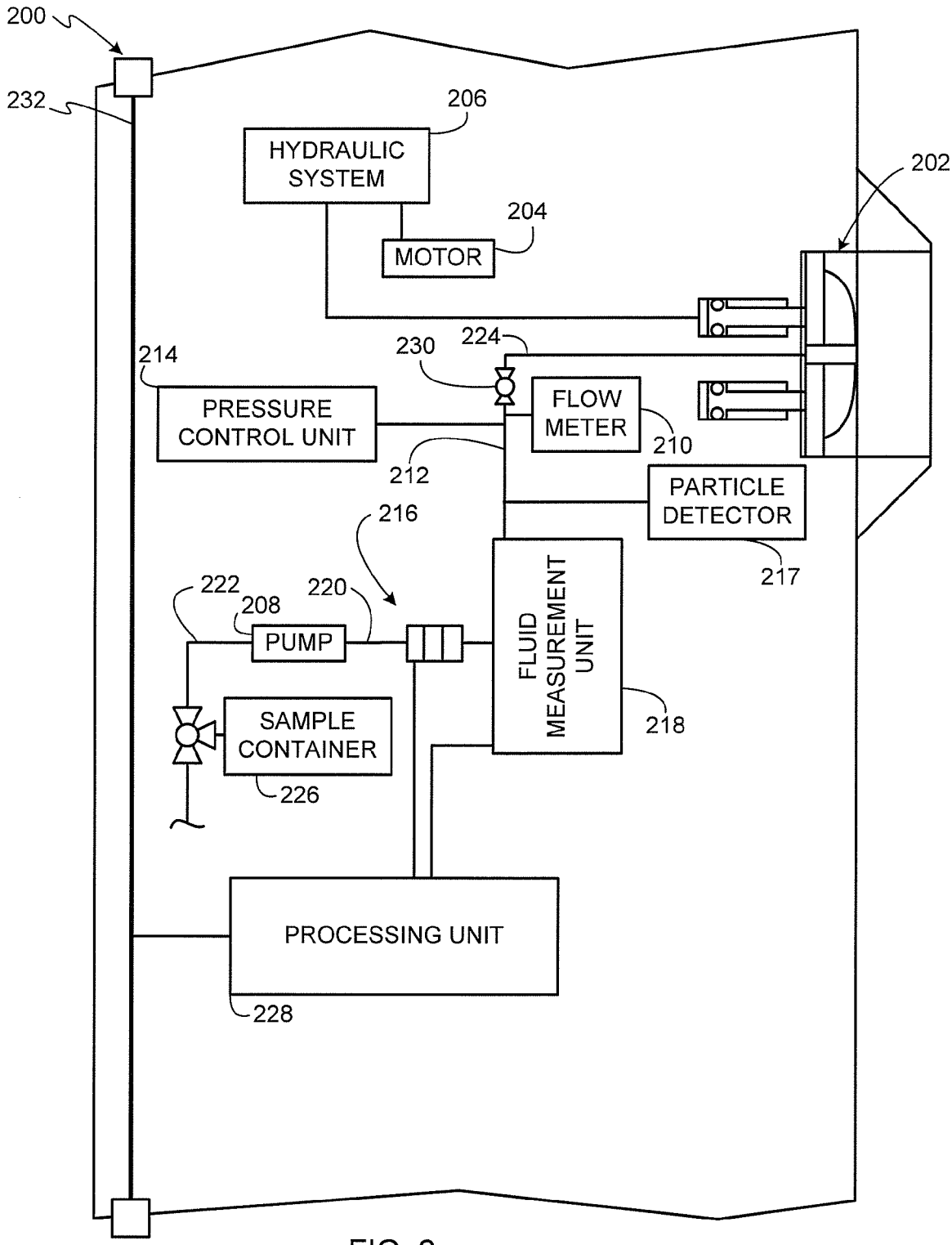
FIG. 2 is a simplified schematic illustration of an example manner in which the formation tester of FIG. 1 may be implemented.

FIG. 2 is a simplified schematic illustration of an example formation sampling tool 200 that may be used to implement the formation tester 114 of FIG. 1. The example formation sampling tool 200 includes a probe assembly 202 that can be selectively engaged to a surface of a wellbore via a motor 204 and a hydraulic system 206 to draw fluids from a formation. In other example implementations, straddle packers (not shown) can additionally or alternatively be used to engage and isolate a portion of the surface of the wellbore to draw fluids from a formation. The formation sampling tool 200 is also provided with a pump 208 that may be used to draw fluids from a formation into the formation sampling tool 200 and/or to circulate or mix fluids obtained from different locations in the wellbore.

In operation, in some examples, the probe assembly 202 draws a first sample of fluid from a first wellbore location (e.g., a first production zone) and a second sample of fluid from a second wellbore location (e.g., a second production zone), which is different than the first wellbore location. A flow meter 210 measures a ratio of a volume of the first sample relative to a volume of the second sample in a flowline 212. The ratio may be representative of an amount of hydrocarbons associated with each of the different wellbore locations. After the first and second fluid samples are in the flowline 212, the pump 208 circulates and/or mixes the samples together to obtain a substantially homogeneous fluid.

The formation sampling tool 200 includes a pressure control unit 214 to change the pressure of the mixture (e.g., the first sample and the second sample) in the flowline 212. In practice, after one of the sensors 216 has identified that the mixture is a substantially homogeneous fluid, the pressure control unit 214 decreases the pressure in the flowline 212 and a particle detector 217 analyzes the mixture to identify the presence of particles in the mixture such as, for example, precipitated asphaltenes or bubbles. Identifying the presence of particles may be advantageously utilized to determine an asphaltene onset pressure, a bubble point and/or a dew point of the mixture.

The formation sampling tool 200 includes one or more fluid sensors to measure characteristics of the fluids drawn into the formation sampling tool 200 and/or to differentiate between particles in the mixture. More specifically, in the illustrated example, the formation sampling tool 200 is provided with a fluid measurement unit 218 to measure one or more parameters or characteristics of formation fluids. The formation fluids may comprise at least one of a heavy oil, a bitumen, a gas condensate, a drilling fluid, a wellbore fluid or, more generally, a fluid extracted from a subsurface formation. The fluid measurement unit 218 may be implemented using, for example, a light absorption spectrometer having a plurality of channels, each of which may correspond to a different wavelength. Thus, the fluid measurement unit 218 may be used to measure spectral information for fluids drawn from a formation. In other implementations, the fluid measurement unit 218 may be implemented using a flowline imager, a VIS/NIR spectrometer, a composition fluid analyzer, an in-situ fluid analyzer, a VIS spectrometer, an NIR spectrometer or any other suitable spectrometer. In operation, if the fluid measurement unit 218 is implemented using a flowline imager, after the particle detector 217 has identified the presence of the particles in the mixture, the fluid measurement unit 218 differentiates between the particles. In particular, the fluid measurement unit 218 classifies each particle as, for example, a precipitated asphaltene or a bubble. Additionally or alternatively, the fluid measurement unit 218 may determine a quantity of precipitated asphaltenes and/or bubbles in the mixture.

The formation sampling tool 200 is also provided with the one or more sensors 216 to measure pressure, temperature, density, fluid resistivity, viscosity, and/or any other fluid properties or characteristics of, for example, the mixture. While the sensors 216 are depicted as being in-line with a flowline 220, one or more of the sensors 216 may be used in other flowlines 212, 222, and 224 within the example formation sampling tool 200.

The formation sampling tool 200 may also include a fluid sample container or store 226 including one or more fluid sample chambers in which formation fluid(s) recovered during sampling operations can be stored and brought to the surface for further analysis and/or confirmation of downhole analyses. In other example implementations, the fluid measurement unit 218 and/or the sensors 216 may be positioned in any other suitable position such as, for example, between the pump 208 and the fluid sample container or store 226.

Figure 6:
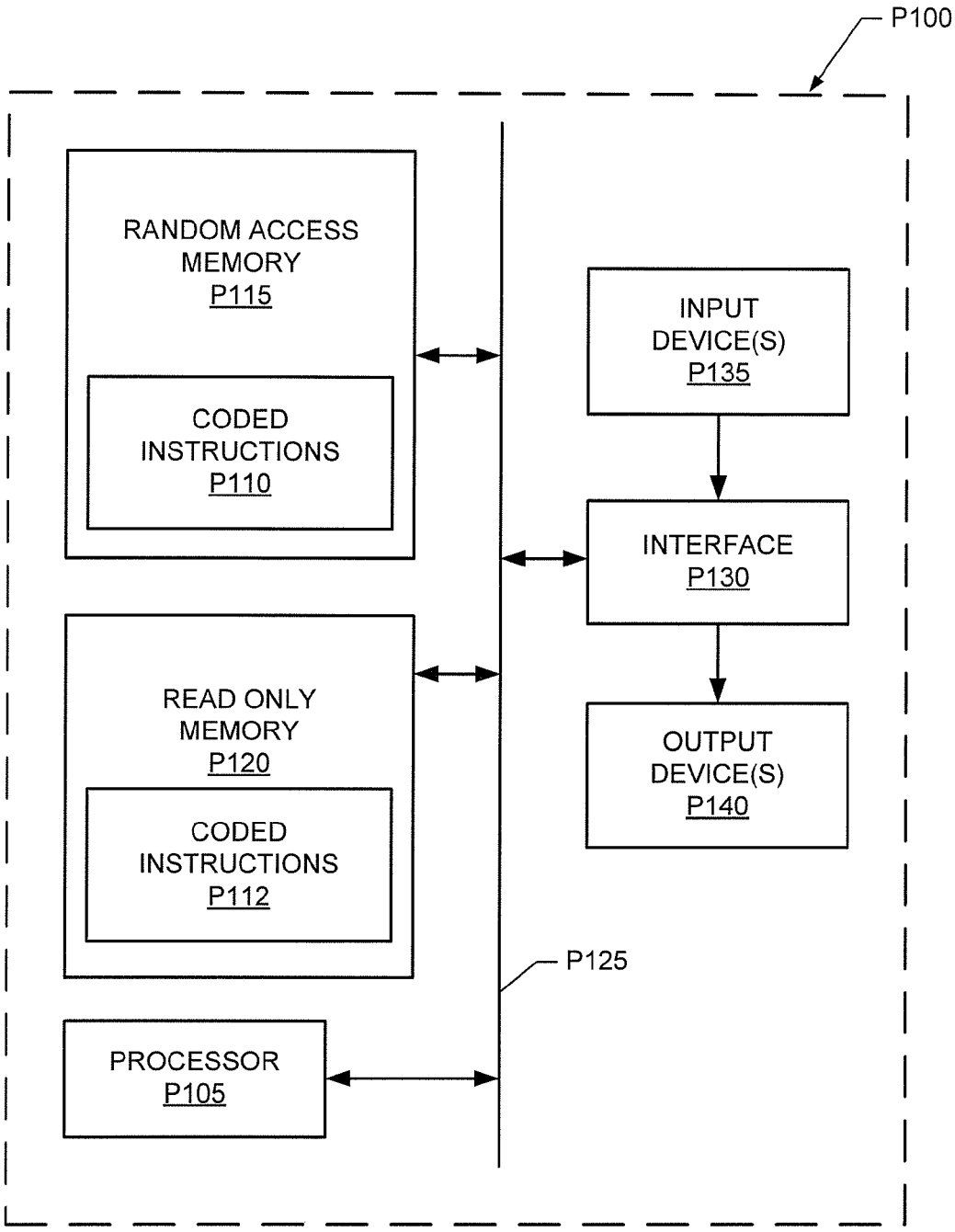
FIG. 6 is a schematic illustration of an example processor platform that may be used and/or programmed to implement any or all of the example methods and apparatus described herein.

To store, analyze and/or process test and measurement data (or any other data acquired by the formation sampling tool 200), the formation sampling tool 200 is provided with a processing unit 228. The processing unit 228 may be generally implemented as shown in FIG. 6. In the illustrated example, the processing unit 228 may include a processor (e.g., a CPU and random access memory such as shown in FIG. 6) to control operations of the formation sampling tool 200 and implement measurement routines. For example, the processing unit 228 may be used to control the fluid measurement unit 218 to perform spectral measurements of fluid characteristics of formation fluid, to actuate a valve 230 to enable a fluid sample to flow into the flowline 212, and to determine an asphaltene onset pressure, a bubble point, a dew point and/or a quantity of asphaltenes (e.g., precipitated asphaltenes) in the mixture. The processing unit 228 may further include any combination of digital and/or analog circuitry needed to interface with the sensors 216 and/or the fluid measurement unit 218.

To store machine readable instructions (e.g., code, software, etc.) that, when executed by the processing unit 228, cause the processing unit 228 to implement measurement processes or any other processes described herein, the processing unit 228 may be provided with an electronic programmable read only memory (EPROM) or any other type of memory (not shown). To communicate information when the formation sampling tool 200 is downhole, the processing unit 228 is communicatively coupled to a tool bus 232, which may be communicatively coupled to a surface system (e.g., the electronics and processing system 106).

Although the components of FIG. 2 are shown and described above as being communicatively coupled and arranged in a particular configuration, the components of the formation sampling tool 200 can be communicatively coupled and/or arranged differently than depicted in FIG. 2 without departing from the scope of the present disclosure. In addition, the example methods and apparatus described herein are not limited to a particular conveyance type but, instead, may be implemented in connection with different conveyance types including, for example, coiled tubing, wireline, wired-drill-pipe, and/or other conveyance means known in the industry.

Figure 3:
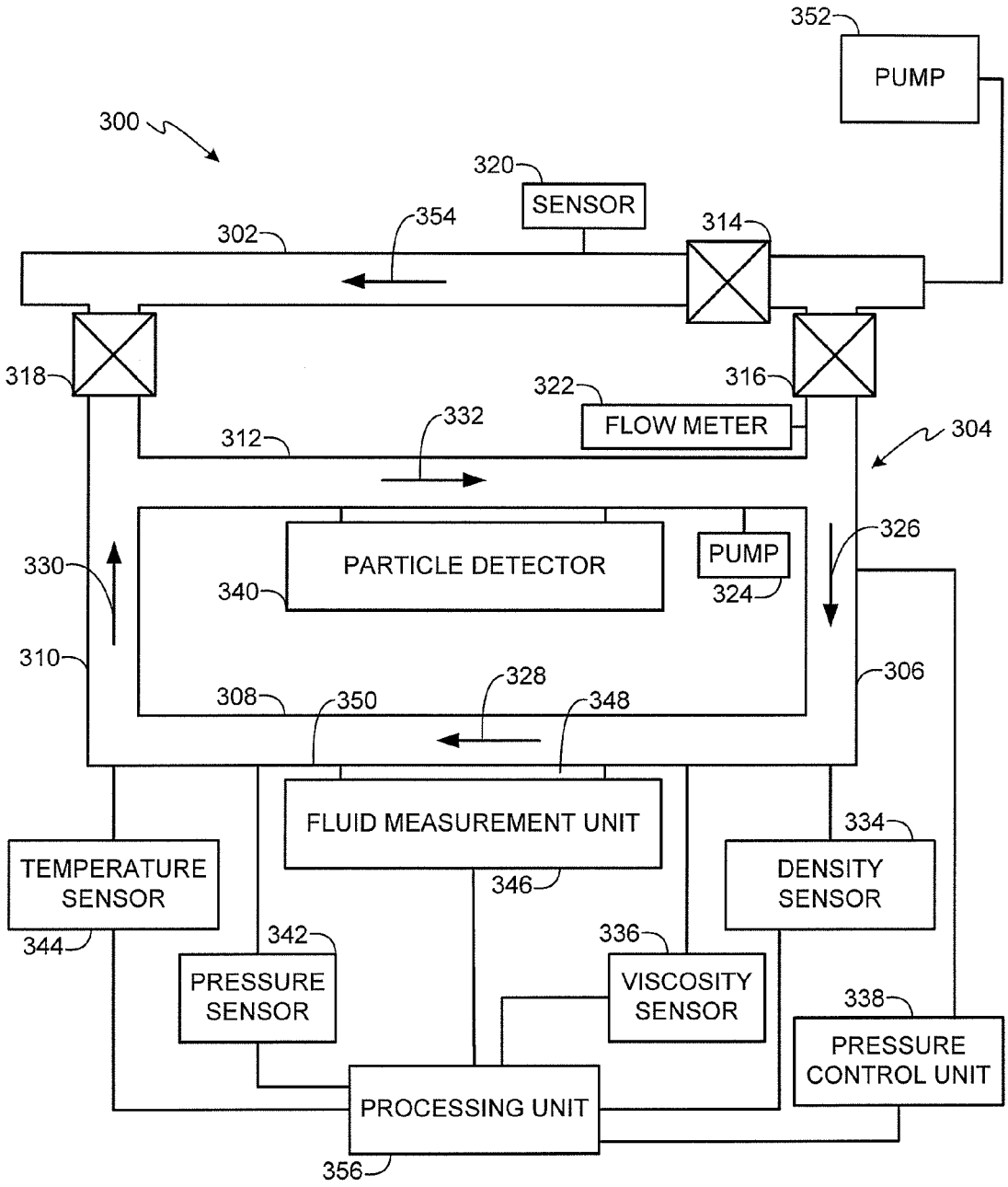
FIG. 3 is a schematic illustration of an example apparatus that may be used to implement the fluid measurement unit of FIG. 2.

FIG. 3 illustrates an example apparatus 300 that may be used to implement a portion of the formation sampling tool 200 associated with the pump 208, the flow meter 210, the flowline 212, the pressure control unit 214, the sensors 216, the particle detector 217, the fluid measurement unit 218, the processing unit 228 and/or the valve 230 of FIG. 2. The example apparatus 300 includes a flowline 302 and a bypass line 304. The bypass line 304 includes a first flowline section 306, a second flowline section 308, a third flowline section 310 and a fourth flowline section 312, each of which is configured to enable a fluid to circulate within the bypass line 304 to obtain a substantially homogeneous mixture. A first valve 314 is positioned along the flowline 302 to control the flow of fluid through the flowline 302. A second valve 316 is positioned along the first flowline section 306 to enable fluid to enter the bypass line 304 from the flowline 302. A third valve 318 is positioned along the third flowline section 310 to enable fluid to exit the bypass line 304 and flow back to the flowline 302.

In operation, the probe assembly 202 (FIG. 2) may obtain a first sample from a first wellbore location, and a sensor 320 may identify a contamination level and a phase of the fluid as it flows through the flowline 302. If the sensor 320 identifies that the contamination level is sufficiently low and that the fluid is single phase, the first valve 314 may close to prevent additional fluid from flowing through the flowline 302. The second valve 316 then opens to enable fluid to flow into the bypass line 304 and the third valve 318 may close to prevent fluid from flowing out of the bypass line 304 and back to the flowline 302. To retain a portion of the sample within the bypass line 304, the second and third valves 316 and 318 may close.

Once the first sample is retained in the bypass line 304, the first valve 314 is opened and the probe assembly 202 (FIG. 2) may obtain a second sample from a second wellbore location in a manner similar to the manner in which the first sample was obtained. After the sensor 320 has identified that the second sample has a relatively low contamination level and is a single phase, the first valve 314 may close to prevent additional fluid from flowing through the flowline 302 and the second valve 316 may open to enable fluid from the second wellbore location to flow into the bypass line 304. The valves 314, 316 and 318 may be any suitable valves that may be operable in subterranean formation conditions.

To measure a volume and/or quantity of a sample in the bypass line 304, the example apparatus 300 is provided with a flow meter 322. In operation, after the first valve 314 has closed and the second valve 316 is opened to enable fluid to flow into the bypass line 304, the flow meter 322 measures the amount of fluid that enters the bypass line 304. In particular, as the sample is flowing into the bypass line 304, the flow meter 322 measures the fluid volume to control a ratio of the first sample relative to the second sample in the bypass line 304. In some examples, the ratio may be representative of an amount of hydrocarbons associated with each of the first and second wellbore locations. The ratio may be, for example, one-to-one (e.g., 1:1), two-to-one (e.g., 2:1), one-to-two (e.g., 1:2), etc. After the predetermined ratio and/or volume of the samples are in the bypass line 304, the second valve 316 closes to retain the mixture in the bypass line 304.

To circulate and/or mix the first and second samples in the bypass line 304, the example apparatus 300 is provided with a pump 324. In operation, after the predetermined ratio and/or volume of the samples are retained in the bypass line 304, the pump 324 pumps the mixture (e.g., the first sample and the second sample) in a direction generally indicated by arrows 326, 328, 330 and 332. However, in other examples, the pump 324 may pump the mixture in a direction opposite the direction generally indicated by the arrows 326, 328, 330 and 332.

To identify when a density and/or a viscosity of the mixture is substantially stable (e.g., a homogeneous mixture), the example apparatus 300 is provided with a density sensor 334 and a viscosity sensor 336. In operation, when the first sample and/or the second sample initially enter the bypass line 304, the density and/or the viscosity of the fluid may be relatively unstable, which leads to inaccurate measurements. However, as the pump 324 circulates and/or mixes the fluid in the bypass line 304, the density and/or the viscosity of the fluid substantially stabilizes, which tends to lead to more accurate measurements. Generally, the density and/or the viscosity sensors 334 and 336 may be advantageously utilized to identify when a sampling analysis may begin to obtain relatively accurate measurements.

Asphaltenes are categorized as components that are insoluble in n-alkanes such as, for example, n-pentane or n-heptane, and soluble in toluene. In some examples, formation fluids (e.g., crude oils) may exist in formations at a pressure higher than a bubble point pressure (e.g., understaturated). In such instances, during production, unless preventative steps are taken, the pressure of the formation fluid may decrease to an asphaltene onset pressure (e.g., asphaltene precipitation onset pressure), which enables previously dissolved asphaltenes to precipitate out of the formation fluid and deposit in the flowlines, etc. While some practical uses of precipitated asphaltenes exist, during production and/or sampling operations, asphaltenes can clog wells, flowlines, surface facilities and/or subsurface facilities. To limit and/or eliminate the effects of asphaltenes during production and/or sampling operations, the examples described herein may be advantageously used to identify the asphaltene onset pressure, the bubble point and/or the dew point of the fluid in the bypass line 304. As a result, during production, a pressure and/or a temperature of the formation fluid extracted from the formation F may be controlled to minimize the adverse effects of asphaltenes on reservoir performance.

To decrease the pressure of the fluid in the bypass line 304, the example apparatus 300 is provided with a pressure control unit 338. As discussed above, as the pressure and/or the temperature of the formation fluid changes, previously dissolved asphaltenes may precipitate. Additionally, as the pressure and/or temperature of the formation fluid changes, a phase of the formation fluid may change (e.g., a liquid phase may change to a partially liquid phase and a partially gaseous phase or to an entirely gaseous phase).

To identify the asphaltene onset pressure, the bubble point and/or the dew point, known techniques typically rely heavily on laboratory analysis. While these techniques may provide accurate results in some instances, to do so, the sample must be representative of the formation fluid and be maintained at reservoir conditions while being transported to the laboratory, which poses significant challenges. In contrast, the examples described herein enable real-time downhole measurements to be obtained from the formation fluid. In particular, after the fluid retained in the bypass line 304 is a substantially homogenous fluid, the pressure control unit 338 decreases the pressure of the mixture and a particle detector 340 may be advantageously utilized to detect particles in the mixture. In some examples, the particle detector 340 may include a near-infrared (NIR) light source on a side of, for example, the fourth flowline section 312 and a fiber-optic sensor opposite the NIR light source. In operation, the NIR light source emits light through the fluid in the fourth flowline section 312 and the fiber-optic sensor detects the light. As the pressure decreases and particles (e.g., precipitated asphaltenes or bubbles) begin to appear in the fluid, the light transmitted through the fluid is scattered, which reduces and/or changes the intensity and/or transmittance power of the light received by the fiber-optic sensor. This change is indicative of an asphaltene onset pressure, precipitation of asphaltenes, bubbles in the fluid, a bubble point and/or a dew point of the mixture.

Once the particle detector 340 detects particles in the fluid, a pressure sensor 342 and a temperature sensor 344 measure the pressure and the temperature of the fluid, respectively. The particles identified by the particle detector 340 may be precipitated asphaltenes and/or bubbles and, thus, measuring the pressure and/or the temperature at the point at which the particles were initially identified may be advantageously utilized to determine the asphaltene onset pressure and/or the bubble point.

To differentiate between the different particles in the fluid, the example apparatus 300 is provided with a fluid measurement unit 346. In particular, the fluid measurement unit 346 may differentiate between precipitated asphaltenes and bubbles. Additionally, the fluid measurement unit 346 may be advantageously utilized to determine a quantity of precipitated asphaltenes in the mixture. The fluid measurement unit 346 is provided with a window 348 (e.g., an optical window) that is substantially adjacent a surface 350 of the second flowline section 308. The window 348 may be implemented using any suitable material such as a scratch resistant material (e.g., a sapphire material). The window 348 may be substantially flush with the surface 350 or the window 348 may be partially positioned within the second flowline section 308.

In operation, to evaluate a subterranean formation using the example apparatus 300, initially, the probe assembly 202 engages the formation at a first wellbore location and a pump 352, which may be used to implement the pump 208 of FIG. 2, pumps fluid (e.g., formation fluid) from the first wellbore location through the flowline 302 in a direction generally indicated by arrow 354. As the fluid moves through the flowline 302, the first valve 314 is in an open position and the sensor 320 may identify if the contamination level of the fluid is equal to or below a predetermined amount. Additionally, as the fluid moves through the flowline 302, the sensor 320 may identify if the fluid is single phase or multiple phases.

After the sensor 320 determines that the fluid from the first wellbore location is acceptable, the first valve 314 actuates to the closed position and the second valve 316 actuates to an open position. The second valve 316 may remain in the open position until a predetermined amount of fluid has entered the bypass line 304, at which point the second valve 316 actuates to the closed position. In particular, the second valve 316 may remain in the open position until the flow meter 322 determines that a predetermined amount of fluid has entered the bypass line 304.

After the sample from the first wellbore location has entered the bypass line 304, the pump 324 circulates the fluid in a direction generally indicated by the arrows 326, 328, 330 and 332 until the density sensor 334 and/or the viscosity sensor 336 have identified that the density and/or the viscosity of the fluid is substantially stable (e.g., a homogeneous mixture) and/or until fluid remaining in the bypass line 304 from previous testing is substantially replaced by the sample from the first wellbore location. After it is determined that the fluid is a substantially homogeneous mixture, the pressure control unit 338 decreases the pressure of the fluid in the bypass line 304 until, for example, the particle detector 340 detects particles in the fluid, which may be indicative of precipitated asphaltenes and/or bubbles. The pressure and temperature sensors 342 and 344 measure the pressure and temperature of the fluid, respectively, and then the fluid measurement unit 346 differentiates between precipitated asphaltenes and/or bubbles in the fluid. The pressure and temperature at which precipitated asphaltenes and/or bubbles are identified in the fluid may be advantageously utilized during production and/or sampling operations to design production strategies that avoid or mitigate asphaltene deposition or, more generally, phase separation of extracted formation fluid. After the measurements are obtained from the fluid, the pressure control unit 338 increases the pressure in the bypass line 304 to redissolve the asphaltenes in the fluid.

To better understand how different production zones, which having fluids with varying composition, affect production, the probe assembly 202 is moved to a second wellbore location and the pump 352 pumps fluid (e.g., formation fluid) from the second wellbore location through the flowline 302 in a direction generally indicated by the arrow 354. As the fluid moves through the flowline 302, the first valve 314 is actuated to an open position and the sensor 320 identifies if the contamination level of the fluid is equal to or below a predetermined amount. Additionally, as the fluid moves through the flowline 302, the sensor 320 may identify if the fluid is single phase or multiple phases. After the sensor 320 determines that the fluid from the second wellbore location is acceptable, the first valve 314 actuates to the closed position and the second valve 316 actuates to the open position to enable fluid from the second wellbore location to enter the bypass line 304, which also contains fluid from the first wellbore location.

The flow meter 322 measures the volume of fluid as the fluid from the second wellbore location flows into the bypass line 304. In particular, the flow meter 322 is advantageously utilized to control a ratio of fluid from the first wellbore location relative to fluid from the second wellbore location. After the flow meter 322 has identified that the desired ratio is achieved, the second valve 316 actuates to the closed position.

The pump 324 then circulates and/or mixes the fluids from the first and second wellbore locations in a direction generally indicated by the arrows 326, 328, 330 and 332 until the density sensor 334 and/or the viscosity sensor 336 have identified that the density and/or the viscosity of the mixture is substantially stable (e.g., a homogeneous mixture).

After it is determined that the mixture is a substantially homogeneous mixture, the pressure control unit 338 decreases the pressure of the mixture in the bypass line 304 until, for example, the particle detector 340 detects particles in the mixture. The pressure and temperature sensors 342 and 344 then measure the pressure and the temperature of the mixture, respectively. Additionally, the fluid measurement unit 346 may differentiate between precipitated asphaltenes and/or bubbles in the mixture. The pressure and temperature at which precipitated asphaltenes and/or bubbles are identified in the mixture may be advantageously utilized during production and/or sampling operations to design production strategies that avoid or mitigate asphaltene deposition or, more generally, phase separations of extracted formation fluid. After the measurements are obtained from the mixture, the pressure control unit 338 increases the pressure in the bypass line 304 to redissolve the asphaltenes into the mixture and then the third valve 318 is actuated to the open position to enable the mixture to flow to the flowline 302.

Figure 4:
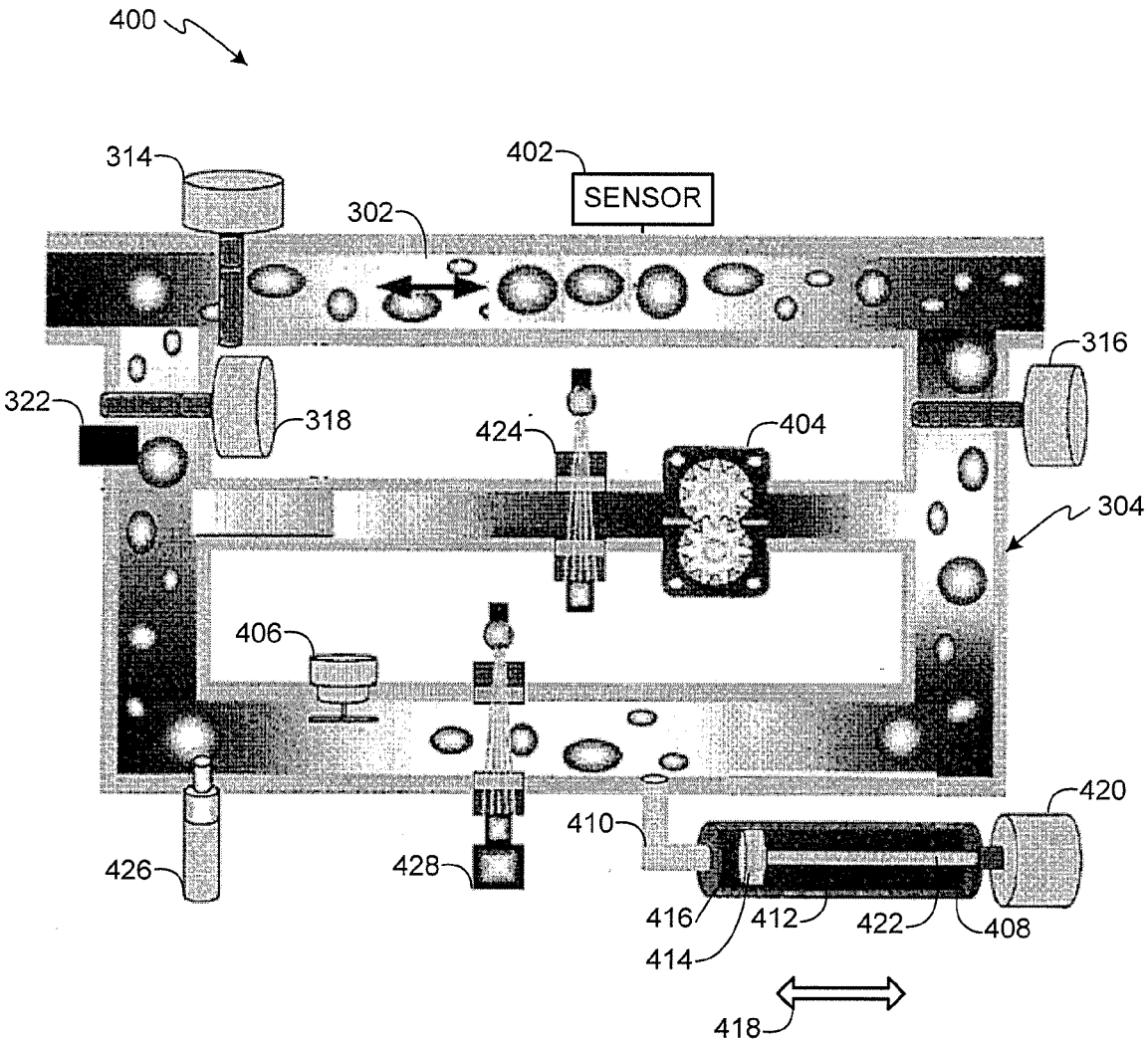
FIG. 4 is a schematic illustration of an example apparatus that may be used to implement the example apparatus of FIG. 3.

FIG. 4 depicts an example apparatus 400 that may be used to implement the example apparatus 300 of FIG. 3. Reference numbers in FIG. 4 that are the same as those used in FIG. 3 correspond to structures that are similar or identical to those described in connection with FIG. 3. As such, the description relating to these structures will not be repeated here.

The example apparatus 400 includes a sensor 402 to identify if the contamination level is sufficiently low and if the fluid is single phase as the fluid flows through the flowline 302. The sensor 402 may be utilized to implement the sensor 320 of FIG. 3. After the contamination level is sufficiently low and the fluid is single phase, the first valve 314 actuates to the closed position and the second valve 316 actuates to the open position to enable fluid to flow into the bypass line 304. Fluid flows from the flowline 302 into the bypass line 304 until the flow meter 322 has identified that a particular amount of fluid has flowed into the bypass line 304 and/or a particular ratio has been achieved between fluids obtained from different wellbore locations (e.g., a first wellbore location, a second wellbore location, a third wellbore location, etc.). To circulate and/or mix the fluid in the bypass line 304, the example apparatus 400 is provided with a circulation pump 404 that may be used to implement the pump 324 of FIG. 3. As the circulation pump 404 circulates the fluid in the bypass line 304, a vibrating rod sensor 406 identifies when a density and/or a viscosity of the mixture is substantially stable. The vibrating rod sensor 406 may be used to implement the density and viscosity sensors 334 and 336 of FIG. 3. Generally, when the vibrating rod sensor 406 has identified that the density and/or a viscosity of the mixture is substantially stable, a sampling operation may begin.

To decrease the pressure of the fluid in the bypass line 304, the example apparatus 300 is provided with a pump unit 408 that may be used to implement the pressure control unit 338 of FIG. 3. The pump unit 408 is fluidly coupled to the bypass line 304 via a flowline section 410. The pump unit 408 defines a bore 412 in which a piston 414 is disposed. The piston 414 is slidably and sealingly engaged to an inner diameter surface 416 of the bore 412 such that as the piston 414 extends and retracts within the bore 412, as indicated by arrow 418, the piston 414 changes the pressure within the bypass line 304. The piston 414 is operatively coupled to a motor 420 via a rod 422.

To identify the presence of particles in the fluid in the bypass line 304, the example apparatus 400 is provided with a scattering detector 424 that may be used to implement the particle detector 340 of FIG. 3. In operation, as the pump unit 408 decreases the pressure of the fluid in the bypass line 304, asphaltenes may begin to precipitate and/or a bubble and/or dew point may be reached, etc. To identify the pressure and/or the temperature at which particles are initially detected in the fluid, the example apparatus 400 is provided with a pressure/temperature sensor 426 that may be used to implement the pressure and temperature sensors 342 and 344 of FIG. 3. To differentiate between the different particles in the fluid, the example apparatus 400 is provided with a flowline imager 428 that may be used to implement the fluid measurement unit 346. Additionally, the flowline imager 428 may be advantageously utilized to determine a quantity of precipitated asphaltenes in the fluid. After the sampling operation is complete, the pump unit 408 may increase the pressure of the fluid in the bypass line 304 to redissolve asphaltenes into the fluid and to ensure that the fluid is substantially a single phase. The third valve 318 may then actuate to the open position to enable the fluid to flow to the flowline 302.

Figure 5A:
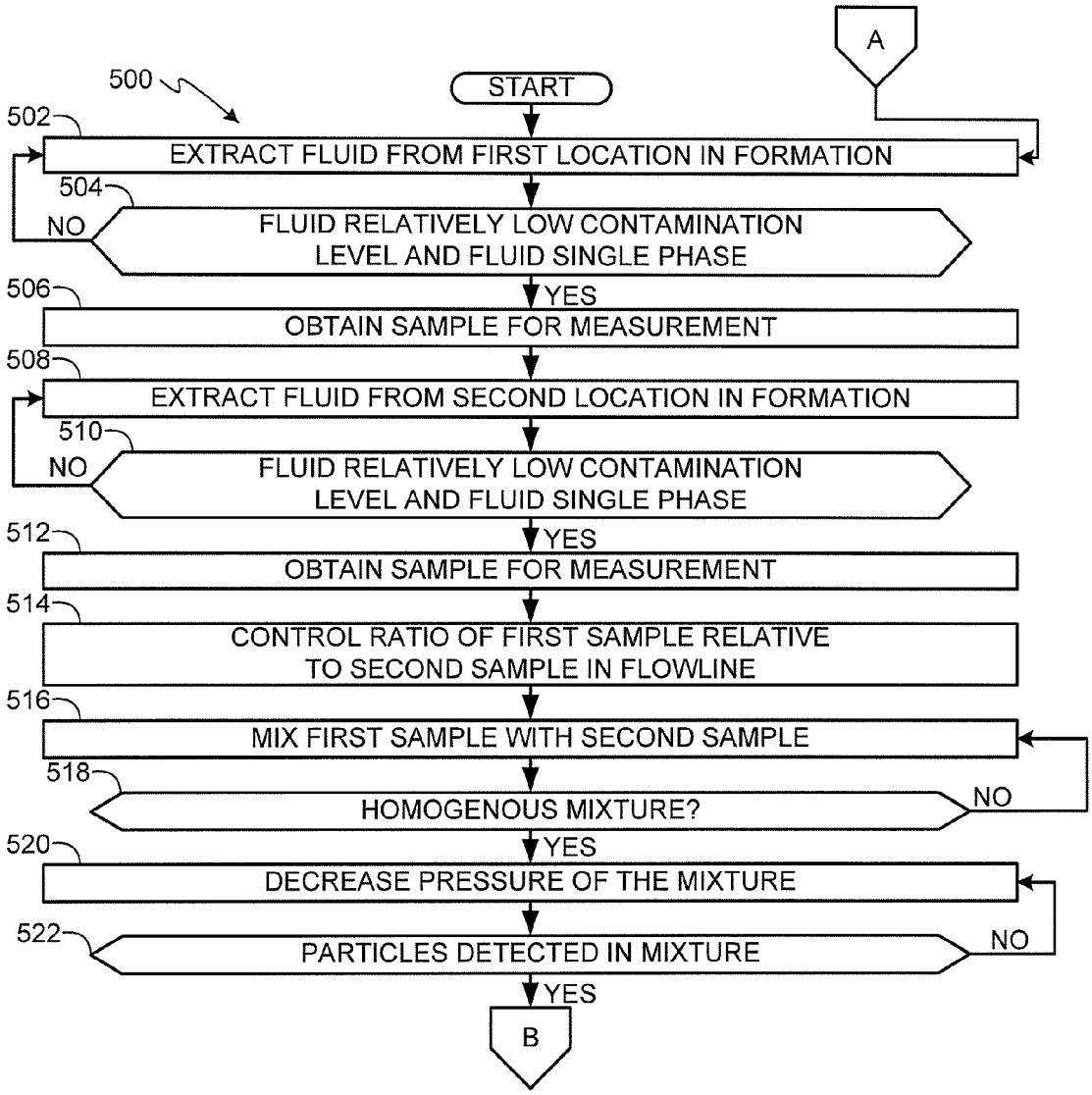
FIGS. 5A and 5B is a flow diagram of an example method that may be used in conjunction with the example apparatus described herein to evaluate a subterranean formation.
Figure 5B:
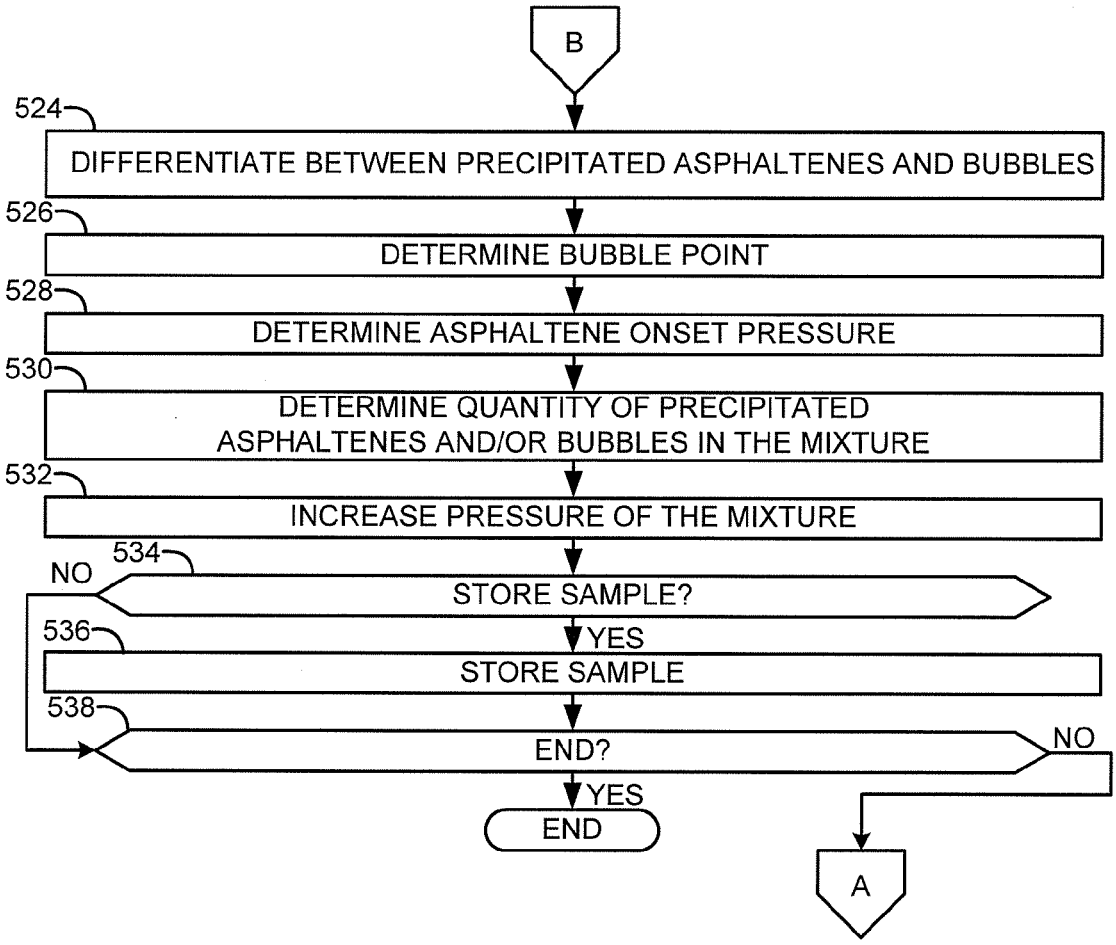

FIGS. 5A and 5B is a flowchart of an example method 500 that can be used in conjunction with the example apparatus described herein to evaluate a subterranean formation (e.g., the formation F of FIG. 1). The example method 500 of FIGS. 5A and 5B may be used to implement the example formation tester 114 of FIG. 1, the formation sampling tool 200 of FIG. 2, the example apparatus 300 of FIG. 3 and/or the example apparatus 400 of FIG. 4. The example method 500 of FIGS. 5A and 5B may be implemented using software and/or hardware. In some example implementations, the flowchart can be representative of example machine readable instructions, and the example method 500 of the flowchart may be implemented entirely or in part by executing the machine readable instructions. Such machine readable instructions may be executed by one or both of the electronics and processing system 106 (FIG. 1), the processing unit 228 of FIG. 2 and/or the processing unit 356 of FIG. 3. In particular, a processor or any other suitable device to execute machine readable instructions may retrieve such instructions from a memory device (e.g., a random access memory (RAM), a read only memory (ROM), etc.) and execute those instructions. In some example implementations, one or more of the operations depicted in the flowchart of FIGS. 5A and 5B may be implemented manually. Although the example method 500 is described with reference to the flowchart of FIGS. 5A and 5B, persons of ordinary skill in the art will readily appreciate that other methods to implement the example formation tester 114 of FIG. 1, the formation sampling tool 200 of FIG. 2, the example apparatus 300 of FIG. 3 and/or the example apparatus 400 of FIG. 4 to evaluate subterranean formations may additionally or alternatively be used. For example, the order of execution of the blocks depicted in the flowchart of FIGS. 5A and 5B may be changed and/or some of the blocks described may be rearranged, eliminated, or combined.

The example method 500 may be used to draw and analyze formation fluids to evaluate the subterranean formation using, for example, the formation sampling tool 200 of FIG. 2. During a planning phase, the electronics and processing system 106 or the processing units 228 and 356 may determine the wellbore locations to obtain fluid samples, the number of samples to be analyzed, and/or the mixing ratio of the obtained samples relative to one another or, more generally, the electronics and processing system 106 or the processing units 228 and 356 may determine a mixing analysis to be conducted. Initially, the probe assembly 202 (FIG. 2) extracts (e.g., admits, draws, etc.) fluid from a first wellbore location (block 502) and the pump 208 (FIG. 2) or 352 (FIG. 3) pumps the fluid through the flowline 212 (FIG. 2) or 302 (FIG. 3). As the fluid flows through the flowline 212 (FIG. 2) or 302 (FIGS. 3 and 4), the sensors 216 (FIG. 2), 320 (FIG. 3) or 402 (FIG. 4) determine if the contamination level is sufficiently low and if the fluid is single phase (block 504). If the processing unit 228 (FIG. 2) or 356 (FIG. 3) determines that the contamination level in the fluid is relatively high and/or if the fluid is in multiple phases, control returns to block 502.

However, if the processing unit 228 (FIG. 2) or 356 (FIG. 3) determines that the contamination level in the fluid is relatively low and the fluid is a single phase, the first valve 314 actuates to the closed position and the second valve 316 actuates to the open position to enable fluid to flow into the bypass line 304. Once a predetermined amount of fluid has entered the bypass line 304, the second valve 316 is actuated to the closed position to retain the fluid in the bypass line 304 (block 506).

The probe assembly 202 (FIG. 2) then extracts (e.g., admits, draws, etc.) fluid from a second wellbore location (block 508) and the pump 208 (FIG. 2) or 352 (FIG. 3) pumps the fluid through the flowline 212 (FIG. 2) or 302 (FIG. 3). As the fluid flows through the flowline 212 (FIG. 2) or 302 (FIGS. 3 and 4), the sensors 216 (FIG. 2), 320 (FIG. 3) or 402 (FIG. 4) determine if the contamination level is sufficiently low and if the fluid is a single phase (block 510). If the processing unit 228 (FIG. 2) or 356 (FIG. 3) determines that the contamination level in the fluid is relatively high and/or if the fluid is in multiple phases, control returns to block 508.

However, if the processing unit 228 (FIG. 2) or 356 (FIG. 3) determines that the contamination level in the fluid is relatively low and the fluid is a single phase, the first valve 314 actuates to the closed position and the second valve 316 actuates to the open position to enable fluid to flow into the bypass line 304. Once a predetermined amount of fluid has entered the bypass line 304, the second valve 316 is actuated to the closed position to retain the fluid in the bypass line 304 (block 512). In particular, the flow meter 210 (FIG. 2) or 322 (FIG. 3) measures an amount of fluid as it flows into the bypass line 304 (FIG. 3) to control a ratio of the first sample (e.g., fluid from the first wellbore location) relative to the second sample (e.g., fluid from the second wellbore location). In examples, the predetermined amount of fluid may be between about 30% or 50% of the bypass line 304 (FIG. 3) volume. Once a predetermined amount of fluid has entered the bypass line 304 and/or a predetermined ratio is attained, the second valve 316 actuates to the closed position to retain fluids from both the first and second wellbore locations in the bypass line 304 (block 514).

The pump 208 (FIG. 2) or 324 (FIG. 3) or the circulation pump 404 (FIG. 4) then circulates and/or mixes the first and second samples (block 516) to ensure that the fluid in the bypass line 304 is a substantially homogeneous mixture. In particular, the sensors 216 (FIG. 2), the viscosity sensor 336 (FIG. 3), the density sensor 334 (FIG. 3) and/or the vibrating rod sensor 406 (FIG. 3) measure the density and/or the viscosity of the fluid as the fluid is circulated in the bypass line 304 to identify if the density and/or the viscosity of the mixture is substantially stable (block 518). If the processing unit 228 (FIG. 2) or 356 (FIG. 3) determines that the fluid is not a homogenous mixture, control returns to block 516.

However, if the processing unit 228 (FIG. 2) or 356 (FIG. 3) determines that the fluid is a homogenous mixture, the pressure control unit 214 (FIG. 2) or 338 (FIG. 3) or the pump unit (FIG. 4) decreases the pressure of the mixture (block 520). As the pressure is reduced, the particle detector 217 (FIG. 2) or 340 (FIG. 3) or the scattering detector 424 (FIG. 4) detects the presence of particles in the mixture (block 522). If particles are not detected in the mixture, control returns to block 522.

However, if the particle detector 217 (FIG. 2) or 340 (FIG. 3) or the scattering detector 424 (FIG. 4) detects the presence of particles in the mixture control passes to block 524 of FIG. 5B. In particular, the fluid measurement unit 218 (FIG. 2) or 346 (FIG. 3) or the flowline imager 428 (FIG. 4) then differentiates between the particles (e.g., precipitated asphaltenes and bubbles) in the mixture (block 524). As discussed above, as the pressure of the mixture decreases, asphaltenes may precipitate out of the fluid and/or the phase of the fluid may change.

Once the particle detector 217 (FIG. 2) or 340 (FIG. 3) or the scattering detector 424 (FIG. 4) detects particles in the mixture and the fluid measurement unit 218 (FIG. 2) or 346 (FIG. 3) or the flowline imager 428 (FIG. 4) determines that the particle is a bubble, the bubble point may be determined (block 526) by, for example, measuring the pressure and the temperature of the mixture via the sensors 216 or the pressure and temperature sensors 342 (FIG. 3), 344 (FIG. 3) or 426 (FIG. 4). Generally, the bubble point is associated with the pressure and temperature conditions at which the first bubble comes out of solution.

Similarly, once the particle detector 217 (FIG. 2) or 340 (FIG. 3) or the scattering detector 424 (FIG. 4) detects particles in the mixture and the fluid measurement unit 218 (FIG. 2) or 346 (FIG. 3) or the flowline imager 428 (FIG. 4) determines that the particle is a precipitated asphaltene, the asphaltene onset pressure may be determined (block 528) by, for example, measuring the pressure and the temperature of the mixture via the sensors 216 or the pressure and temperature sensors 342 (FIG. 3), 344 (FIG. 3) or 426 (FIG. 4).

Additionally, the fluid measurement unit 218 (FIG. 2) or 346 (FIG. 3) or the flowline imager 428 (FIG. 4) may determine the quantity of precipitated asphaltenes and/or bubbles in the mixture (block 530).

After the measurements have been obtained from the sample in the bypass line 304, the pressure control unit 214 (FIG. 2) or 338 (FIG. 3) or the pump unit 412 (FIG. 4) may increase the pressure (block 532) of the fluid to redissolve the asphaltenes into the fluid and/or to ensure that the fluid is a single phase.

The processing unit 228 (FIG. 2) or 356 (FIG. 3) then determines if the fluid is to be stored in the fluid collecting chambers 122 or 124 of FIG. 1 or the sample container or store 226 of FIG. 2 (block 534). If the processing unit 228 (FIG. 2) or 356 (FIG. 3) determines a fluid sample is to be stored, the sample is routed to any of the fluid collecting chambers 122 or 124 of FIG. 1 or the sample container or store 226 of FIG. 2 (block 536). Otherwise the fluid may be expelled through a port (not shown).

The processing unit 228 (FIG. 2) or 356 (FIG. 3) then determines whether it should extract fluid from another location (block 538). For example, if the formation sampling tool 200 (FIG. 2) has drawn another formation fluid sample and the processing unit 228 (FIG. 2) or 356 (FIG. 3) has not received an instruction or command to stop analyzing fluid, control may return to block 502 of FIG. 5A. Otherwise, the example process of FIGS. 5A and 5B is ended.

FIG. 6 is a schematic diagram of an example processor platform P100 that may be used and/or programmed to implement to implement the electronics and processing system 106, the processing units 228 and 356, the particle detectors 217 and 340, the fluid measurement units 218 and 346, the scattering detector 424 and the flowline imager 428. For example, the processor platform P100 can be implemented by one or more general purpose processors, processor cores, microcontrollers, etc.

The processor platform P100 of the example of FIG. 6 includes at least one general purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method of evaluating a subterranean formation, comprising:

obtaining a first sample from a first wellbore location;

obtaining a second sample from a second wellbore location different than the first wellbore location;

mixing the first sample with the second sample in a flowline to obtain a substantially homogenous mixture; and measuring a parameter of the mixture to evaluate the subterranean formation.

2. The method as defined in claim 1, further comprising changing a pressure of the mixture in the flowline to identify at least one of a bubble point or a dew point of the mixture.

3. The method as defined in claim 1, further comprising changing a pressure of the mixture in the flowline to identify a phase behavior.

4. The method as defined in claim 1, further comprising changing a pressure of the mixture to identify an asphaltene onset pressure.

5. The method as defined in claim 1, wherein the first wellbore location is associated with a first production zone and the second wellbore location is associated with a second production zone.

6. The method as defined in claim 1, further comprising controlling a ratio of the first sample relative to the second sample in the flowline via a flow meter.

7. The method as defined in claim 6, wherein the ratio is substantially representative of an amount of hydrocarbons associated with each of the first wellbore location and the second wellbore location.

8. The method as defined in claim 1, further comprising decreasing a pressure of the mixture to measure parameters of the mixture.

9. The method as defined in claim 8, wherein the parameters include a quantity of precipitated asphaltenes or bubbles in the mixture.

10. The method as defined in claim 8, further comprising increasing the pressure of the mixture after the parameters are measured.

11. The method as defined in claim 8, further comprising storing the mixture in a chamber after the parameters are measured.

12. The method as defined in claim 9, further comprising differentiating between the precipitated asphaltenes or the bubbles in the mixture.

13. An apparatus to evaluate a subterranean formation, comprising:

a flowline configured to enable fluid obtained from a first wellbore location and a second wellbore location to circulate to obtain a substantially homogenous mixture;

a flow meter to control a ratio of the fluid from the first wellbore location relative to the fluid from the second wellbore location; and a fluid measurement unit to measure a parameter of the substantially homogenous mixture to evaluate the subterranean formation.

14. The apparatus as defined in claim 13, further comprising a pressure control unit to change a pressure of the substantially homogenous mixture to at least one of an asphaltene onset pressure, a bubble point or a dew point.

15. The apparatus as defined in claim 13, further comprising a pump to circulate the fluid obtained from the first wellbore location and the second wellbore location in the flowline.

16. A method of identifying an asphaltene onset pressure of a mixed fluid obtained from a subterranean formation comprising:

obtaining a mixed fluid from the subterranean formation;

changing a pressure of the mixed fluid; and identifying the asphaltene onset pressure to limit or eliminate precipitation of asphaltenes during sampling or production, wherein the mixed fluid comprises at least a first fluid sample from a first wellbore location and a second fluid sample from a second wellbore location.

17. The method as defined in claim 16, further comprising controlling a ratio of the first fluid sample relative to the second fluid sample via a flow meter.

18. The method as defined in claim 16, further comprising identifying a bubble point of the mixed fluid to limit or eliminate phase changes during sampling or production.

19. The method as defined in claim 16, further comprising increasing the pressure of the mixture after the asphaltene onset pressure has been identified.

* * * * *